US008757428B2

(12) United States Patent
Daudelin

(10) Patent No.: US 8,757,428 B2
(45) Date of Patent: Jun. 24, 2014

(54) REFUSE CONTAINER WITH HANDLING FEATURES

(76) Inventor: Marvin D. Daudelin, Pinellas Park, FL (US)

( * ) Notice: Subject to any disclaimer, the term of this patent is extended or adjusted under 35 U.S.C. 154(b) by 94 days.

(21) Appl. No.: 13/237,183

(22) Filed: Sep. 20, 2011

(65) Prior Publication Data

US 2013/0067868 A1 Mar. 21, 2013

(51) Int. Cl.
*B65D 25/28* (2006.01)

(52) U.S. Cl.
USPC ..... 220/761; 220/908; 280/47.26

(58) Field of Classification Search
USPC ..... 220/908, 908.1, 761, 628, 632, 676, 220/752, 772, 775, 762, 212.5; 280/47.26
See application file for complete search history.

(56) References Cited

U.S. PATENT DOCUMENTS

| | | | | |
|---|---|---|---|---|
| 2,425,612 | A | 8/1947 | Gamber | |
| 3,434,625 | A * | 3/1969 | Embry, Jr. | 220/495.06 |
| 4,254,602 | A | 3/1981 | Boynton | |
| D269,643 | S | 7/1983 | Hartman et al. | |
| 4,401,312 | A * | 8/1983 | Parker | 280/47.17 |
| 4,872,582 | A * | 10/1989 | Sipple | 220/603 |
| 5,088,750 | A * | 2/1992 | Beese et al. | 280/47.26 |
| 5,535,910 | A * | 7/1996 | Cassel | 220/212 |
| D381,516 | S | 7/1997 | Andryzeck et al. | |
| 6,189,752 | B1 | 2/2001 | Perry | |
| 6,276,557 | B1 * | 8/2001 | Wysocki | 220/608 |
| 6,457,880 | B1 | 10/2002 | Slot et al. | |
| 6,769,702 | B2 * | 8/2004 | Young | 280/47.26 |
| 6,808,081 | B1 * | 10/2004 | Citro | 220/772 |
| 7,172,088 | B2 | 2/2007 | McDade et al. | |
| 7,350,999 | B2 | 4/2008 | Brletich et al. | |
| D578,267 | S | 10/2008 | Yang et al. | |
| 7,469,798 | B1 * | 12/2008 | Miller | 220/675 |
| 7,575,246 | B1 | 8/2009 | Lunski | |
| 2009/0084794 | A1 * | 4/2009 | Vaiana et al. | 220/495.06 |
| 2009/0293667 | A1 * | 12/2009 | Ogburn | 74/551.8 |

* cited by examiner

*Primary Examiner* — Jeffrey Allen
(74) *Attorney, Agent, or Firm* — Robert C. Montgomery; Montgomery Patent & Design

(57) ABSTRACT

A refuse carrying device with a variety of handling features includes a container, an attachable secondary handle, an attachable wheel assembly, and a shoulder resting recess. The durable container has an open top adapted for receiving refuse. Opposing sides of a top edge of the container include a pair of handles. The selectably attachable secondary side handle and the selectably attachable wheel assembly are positioned along an outer lower perimeter edge of the container. The shoulder recess is an indentation along the lower perimeter edge opposite the secondary handle and includes an attachable padded cushion to line the recess. A user places the shoulder rest in contact with the shoulder and grips the secondary handle to carry the container upon the shoulder region.

15 Claims, 10 Drawing Sheets

REFUSE CONTAINER WITH HANDLING FEATURES

RELATED APPLICATIONS

The present invention was first described in a notarized Official Record of Invention on Aug. 11, 2010, that is on file at the offices of Montgomery Patent and Design, LLC, the entire disclosures of which are incorporated herein by reference.

FIELD OF THE INVENTION

The present invention relates generally to refuse containers, and in particular, to a refuse container with handling features to provide for carrying and pushing and pulling modes of transportation of the refuse container and an amount of refuse.

BACKGROUND OF THE INVENTION

As anyone who performs a lot of physical work will attest, nothing beats having the proper tool for a job. The proper tool can save time and money, produces a higher quality job, reduces damage to equipment, and provides for increased safety of a worker. No matter the field of work, one aspect of almost all projects is the removal of trash and other debris. Such refuse is typically placed into trash cans and carried to a central collection point such as a dumpster. This means the trash cans must be carried long distances thus subjecting the worker to muscle aches and pains in their arms and backs. These same problems exist when carrying conventional trash cans around the home as well.

Garbage cans and trash receptacles are known in the art and a wide variety of options are available to a consumer. The design of the garbage can ranges from simple cylindrical cans to large wheeled containers, including hingedly attached covers and weighted bases. While these designs may achieve their intended objectives, each suffers from one (1) or more disadvantage or deficiency related to design or utilization. In particular, improvements to refuse containers have been limited to providing more convenient wheeled transportation or making the containers less likely to tip or be knocked over. There has unfortunately been little done to improve the overall carryability of the container.

SUMMARY OF THE INVENTION

The inventor has therefore recognized the aforementioned inherent problems and lack in the art and observed that there is a need for a refuse carrying device that can be easily carried in a manner to address the above mentioned problems. In accordance with the invention, it is an object of the present disclosure to solve these problems.

The inventor recognized these problems and has addressed this need by developing a refuse carrying device that allows one to move refuse containers for relatively long distances in a manner which is easy, effective, and comfortable for the carrier. The inventor has thus realized the advantages and benefits of providing a container having an open top and a hollow interior with a pair of primary handles affixed to an upper perimeter of the container. A handle recess is disposed in a bottom surface of the container contiguous with a lower perimeter edge of the container. A fixed handle is affixed within the handle recess to provide another gripping and handling feature. A shoulder recess is disposed in the bottom surface of the container contiguous with the lower perimeter edge opposite the handle recess for contact with a shoulder of a carrier when the container is carried. A secondary handle is selectably attachable to the container within the shoulder recess for use when the container is lifted. A wheel assembly is selectably attachable to the container within the shoulder recess for use when the container is rolled.

The accessory recess includes a pair of opposing detents to insertably receive opposing ends of either the secondary handle or the wheel assembly. The secondary handle includes a cylindrical body having a handle pin disposed on each opposing end with at least one (1) handle pin being retractable within the cylindrical body and an interior spring to bias the handle pin outwardly. The wheel assembly includes a cylindrical axle having at least one (1) rotatably connected wheel and an axle pin disposed on each opposing end with at least one (1) axle pin being retractable within the axle and an interior spring to bias the axle pin outwardly. A cushioned shoulder pad is removably attachable within the shoulder recess for comfortable contact with the shoulder for use when the container is carried. A lid is provided which is removably coupled to the open top of the container to cover the interior.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
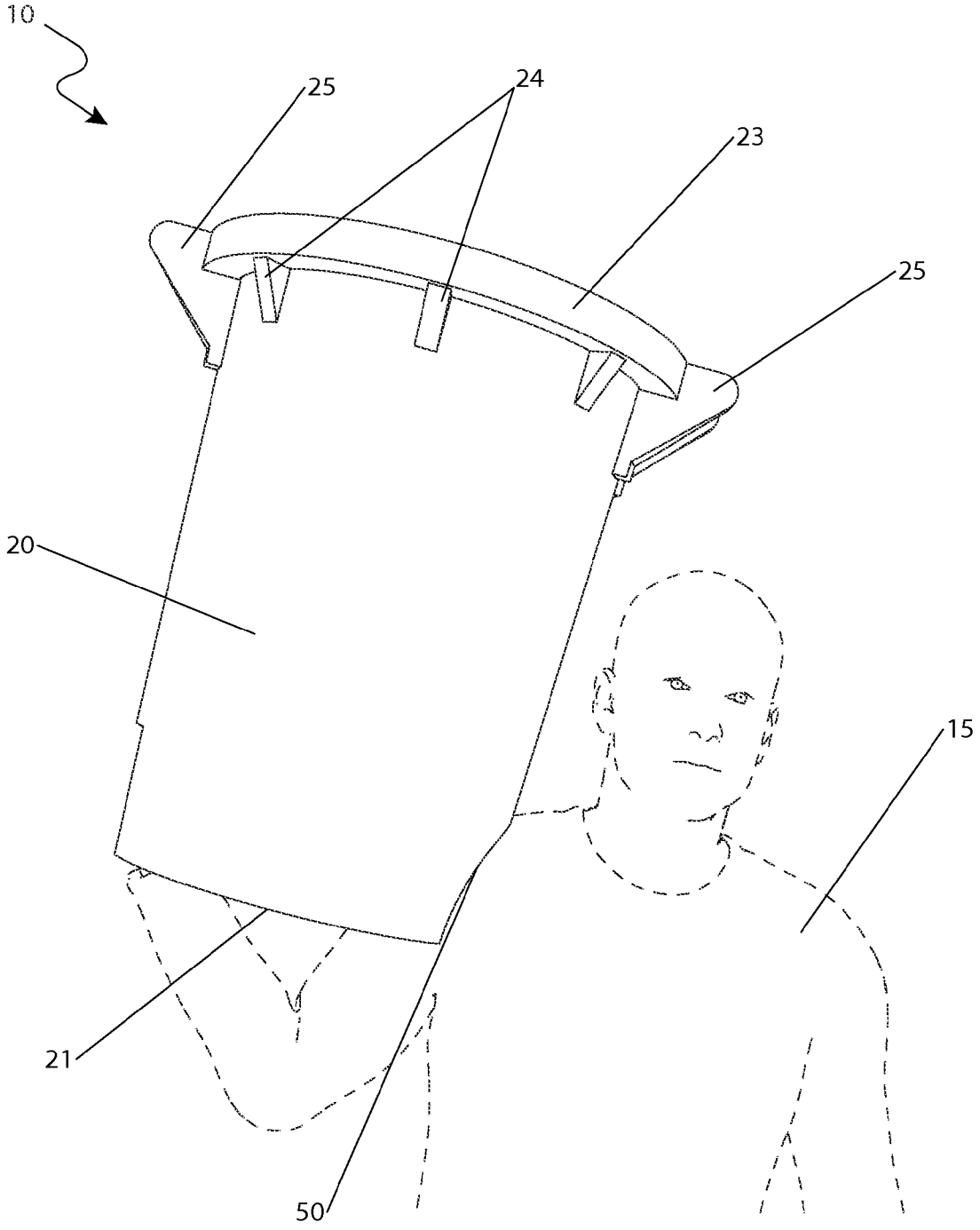
FIG. 1 is an environmental view of a refuse carrying device, according to a preferred embodiment in accordance with the invention.

10 refuse carrying device
15 user

20 container
21 bottom surface
22 interior
23 collar
24 stiffening feature
25 primary handle
30 handle recess
31 fixed handle
35 lid
36 lid handle
37 lid collar
40 secondary handle
41 fixed pin
42 compressible pin
43 spring
44 wheel assembly
45 bearing
46 axle
50 shoulder recess
51 shoulder pad
52 attachment fastener
53 detent
54 container finger relief
55 shoulder pad finger relief

DETAILED DESCRIPTION OF THE PREFERRED EMBODIMENT

In accordance with the invention, the best mode is presented in terms of a preferred embodiment, herein depicted within FIGS. 1 through 13. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 13, depicting a refuse carrying device (herein described as a "device") 10, where like reference numerals represent similar or like parts. In accordance with the invention, the present disclosure describes a device 10 which provides additional carrying and handling features for transporting the device 10 to a location in a comfortable and effective manner. The device 10 provides an interior portion for placement of refuse, such as garbage, yard debris, and the like. The device 10 is fabricated from a rigid and durable plastic, yet other materials can be utilized without limiting the scope of the device 10. The device 10 is intended to be manufactured in a variety of sizes to correspond to the needs of a user 15.

FIG. 1 shows an environmental view of the device 10. The device 10 includes a cylindrical open-top container 20 having a pair of opposing primary handles 25. The primary handles 25 provide the user 15 with a gripping surface for lifting or transporting the container 20 to a selected location. Each primary handle 25 is approximately eight (8) inches in length. A bottom surface 21 of the container 20 includes a handle recess 30 and a shoulder recess 50 which provide alternate methods of assisting the user in transporting the container 20 to the selected location. The handle recess 30 allows the device 10 to be lifted and carried by gripping a fixed handle 31 disposed within the handle recess 30. The handle recess 30 can also be utilized in combination with the shoulder recess 50 to allow the user 15 to position the device 10 upon the user's shoulder. This method of carrying the device 10 disperses the weight and its contents upon an upper portion of the user's back and shoulders in lieu of the lower back area, such as when a trash receptacle is carried in a normal manner. This carrying technique allows the device 10 to be carried over a relatively long distance in comfort limiting the risk of injury to the lower back area.

Figure 2:
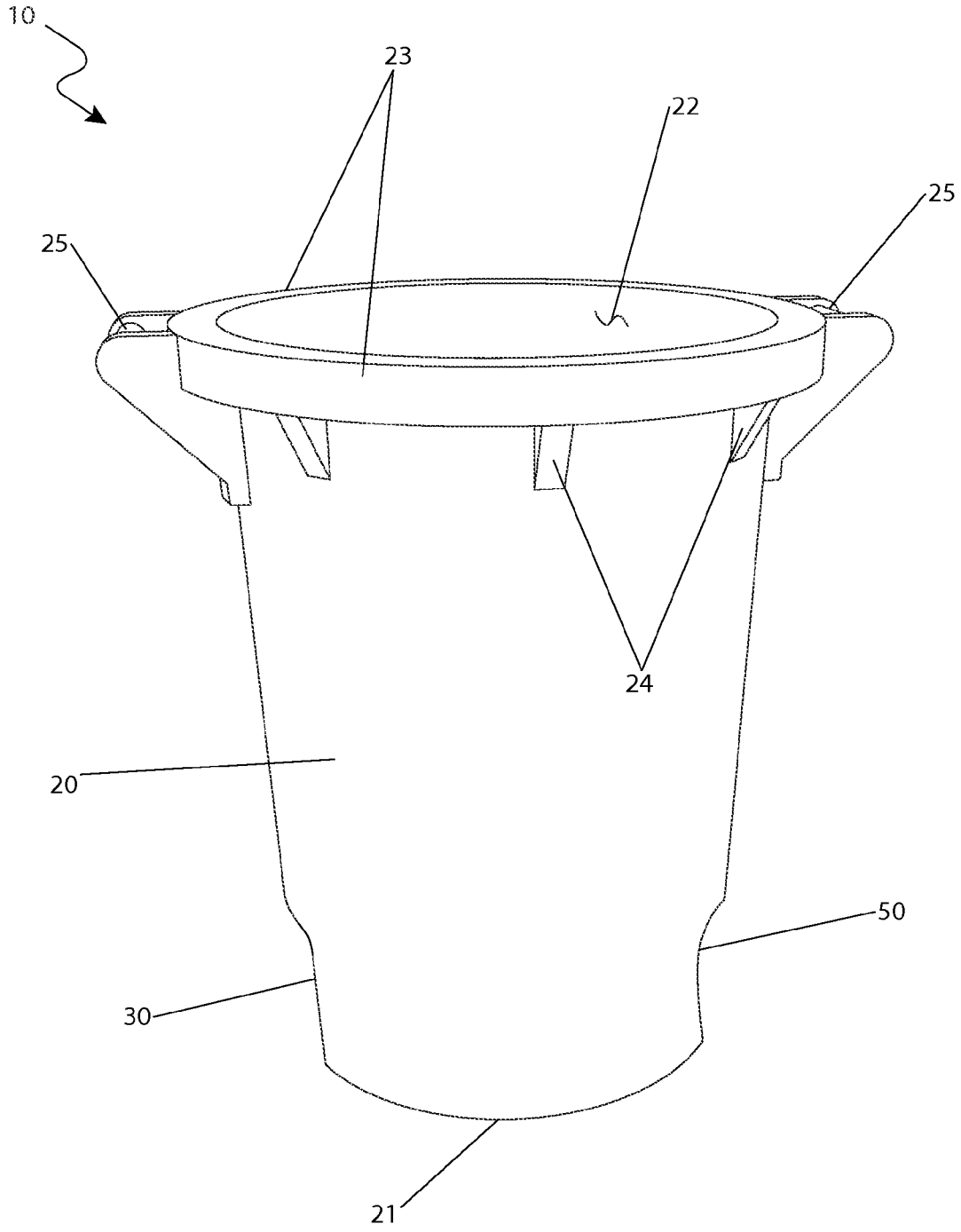
FIG. 2 is a perspective view of the refuse carrying device, according to the preferred embodiment.
Figure 3:
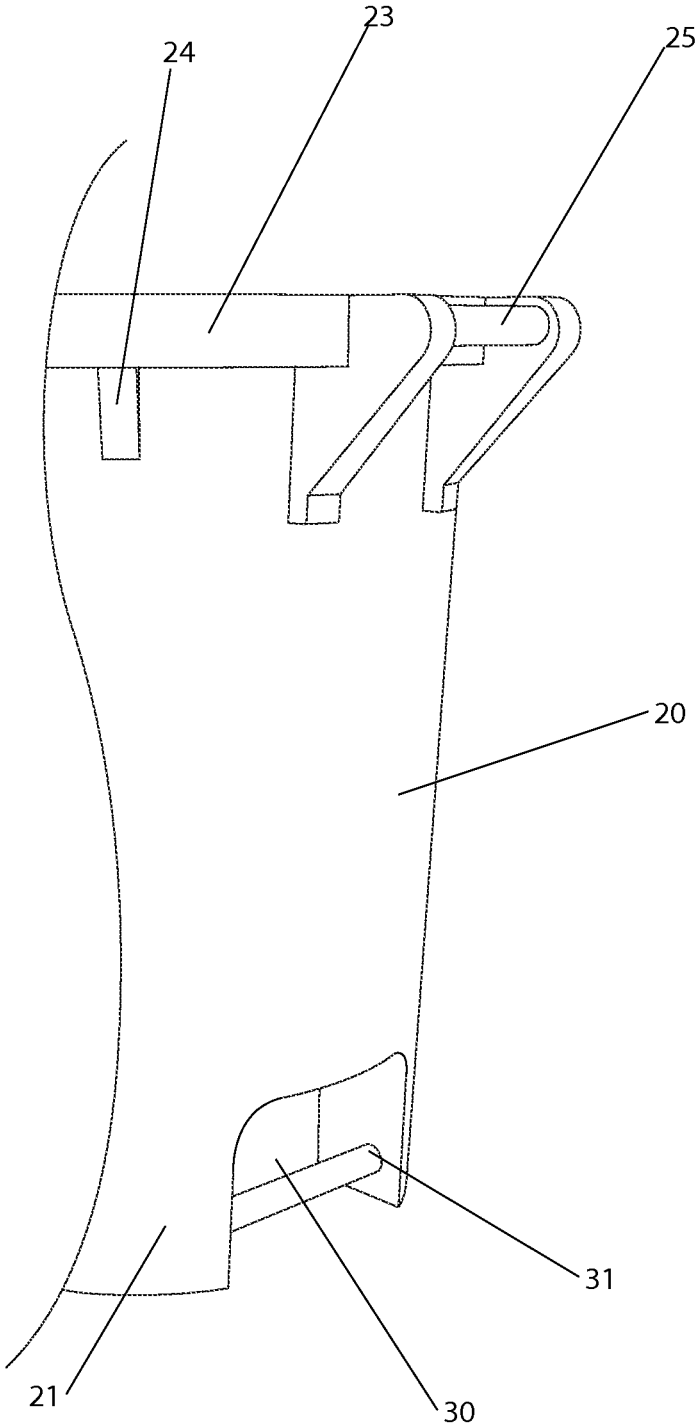
FIG. 3 is a partial side perspective view of the refuse carrying device, according to the preferred embodiment.

FIG. 2 shows a perspective view of the device 10 and FIG. 3 shows a perspective side view of the device 10. The open-top cylindrical container 20 is preferably fabricated from a durable plastic material. The open-top provides access to a hollow interior 22 for placement of desired contents such as garbage, yard debris, or the like. An upper perimeter of the container 20 includes a collar 23 which is supported by a plurality of integrally molded stiffening features 24 along a bottom surface of the collar 23. The stiffening features 24 stabilize the collar 23. The collar 23 provides an additional gripping surface for the user 15 and also strengthens the rim of the container 20 to protect against damage. Opposing edges of the collar 23 are integrally molded into the primary handles 25. The primary handles 25 provide the user 15 with gripping handles to lift and transport the device 10. Each primary handles 25 is an integrally molded rod disposed between a "U"-shaped connection integrally molded into the exterior of the rim of the container 20. It can be appreciated that other handle moldings or connections can be utilized without limiting the scope of the device 10.

Figure 4:
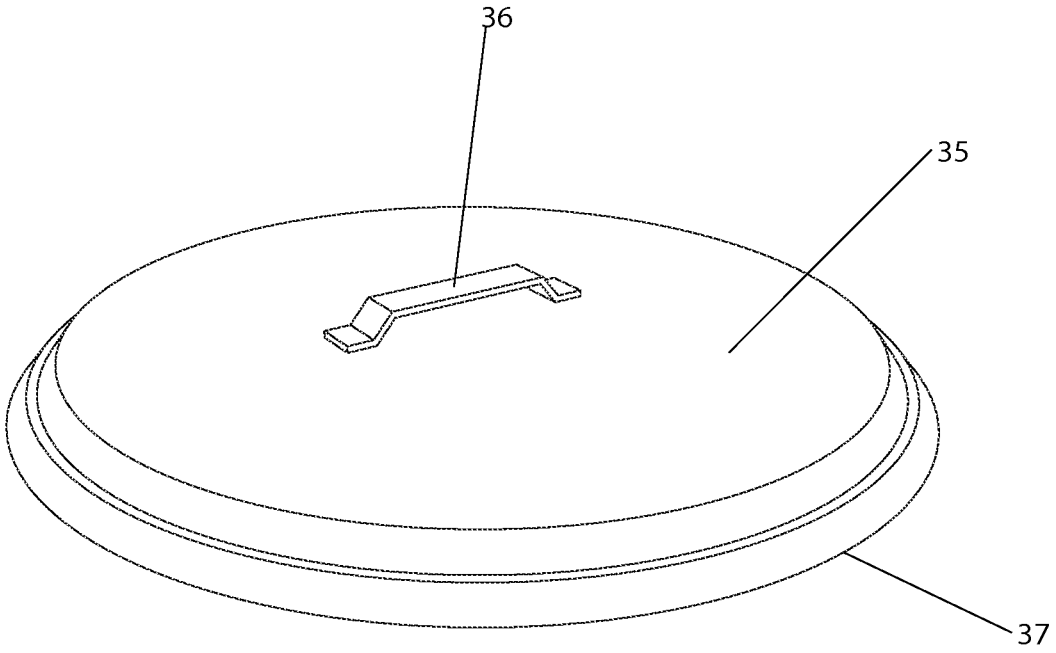
FIG. 4 is a top perspective view of a lid, according to the preferred embodiment.
Figure 5:
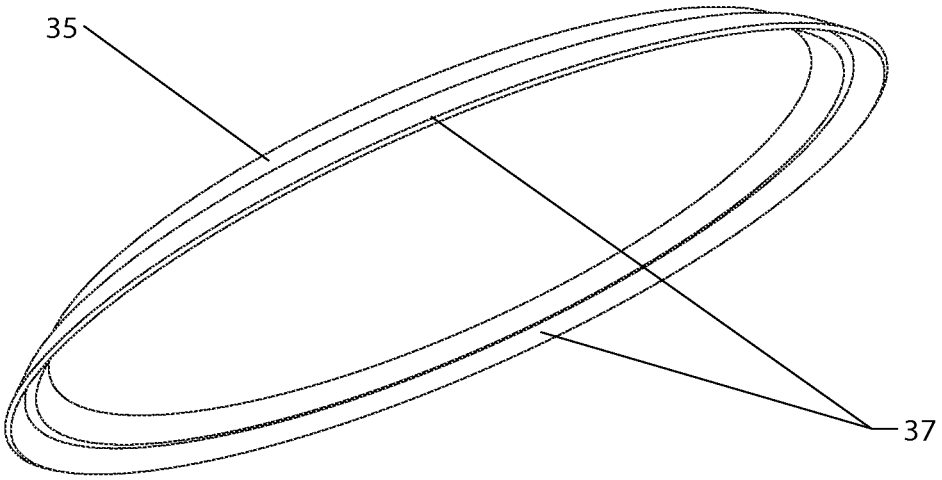
FIG. 5 is a bottom perspective view of the lid, according to the preferred embodiment.

FIG. 4 shows a top perspective view of the lid 35 and FIG. 5 shows a bottom perspective view of the lid 35. The lid 35 provides a closing and covering feature for the open-topped container 20. The lid 35 has a perimeter shape suitable to mate with the open rim of the container 20. Here the lid 35 is shown having a cylindrical shape with a diameter which corresponds to the container 20. The lid 35 includes a lid handle 36 on an upper intermediate surface for the user 15 grip to position the lid 35 on the container 20 or remove it from the container 20. A bottom perimeter edge of the lid 35 includes a lid collar 37 which provides an interference fit to secure the lid 35 to an upper perimeter edge of the collar 23. The lid 35 is fabricated from materials similar to the container 20.

Figure 6:
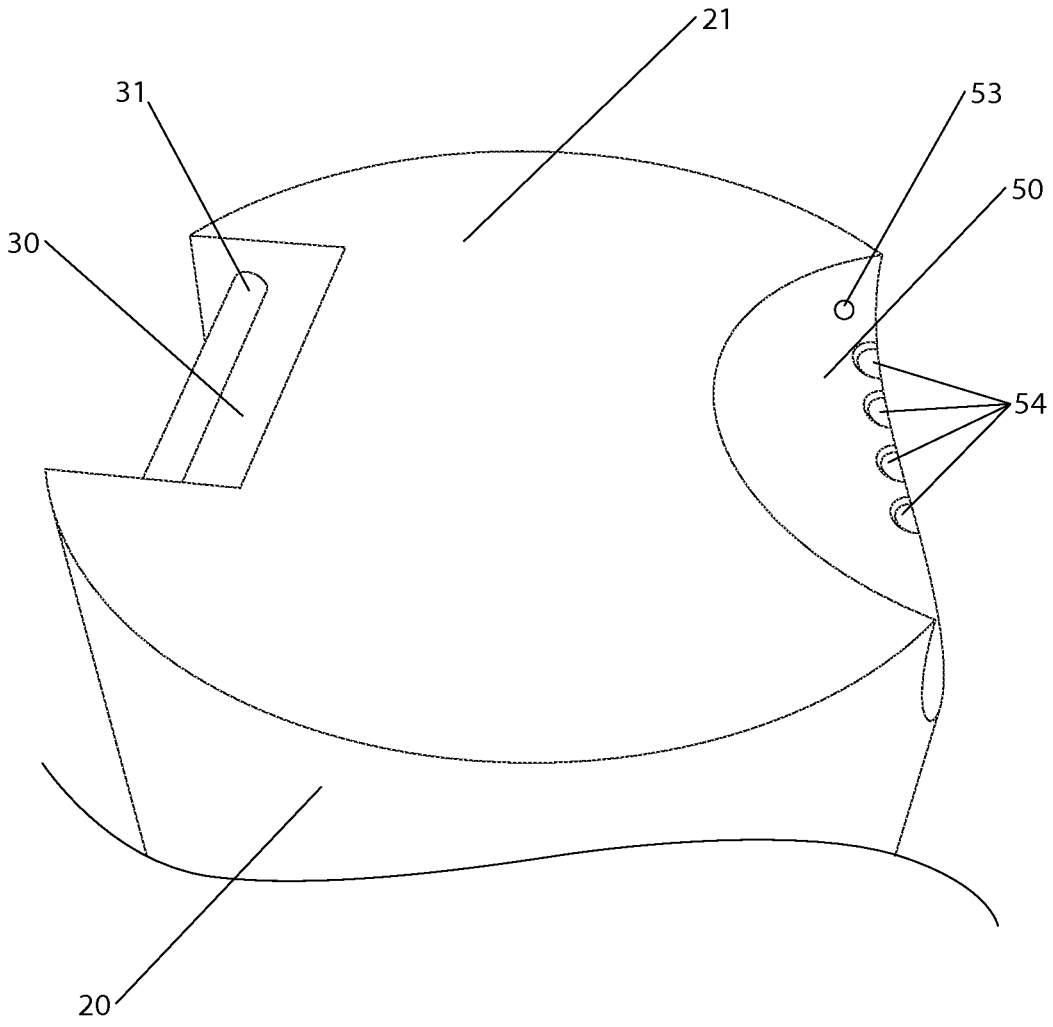
FIG. 6 is a partial bottom perspective view of the refuse carrying device, according to the preferred embodiment.
Figure 7:
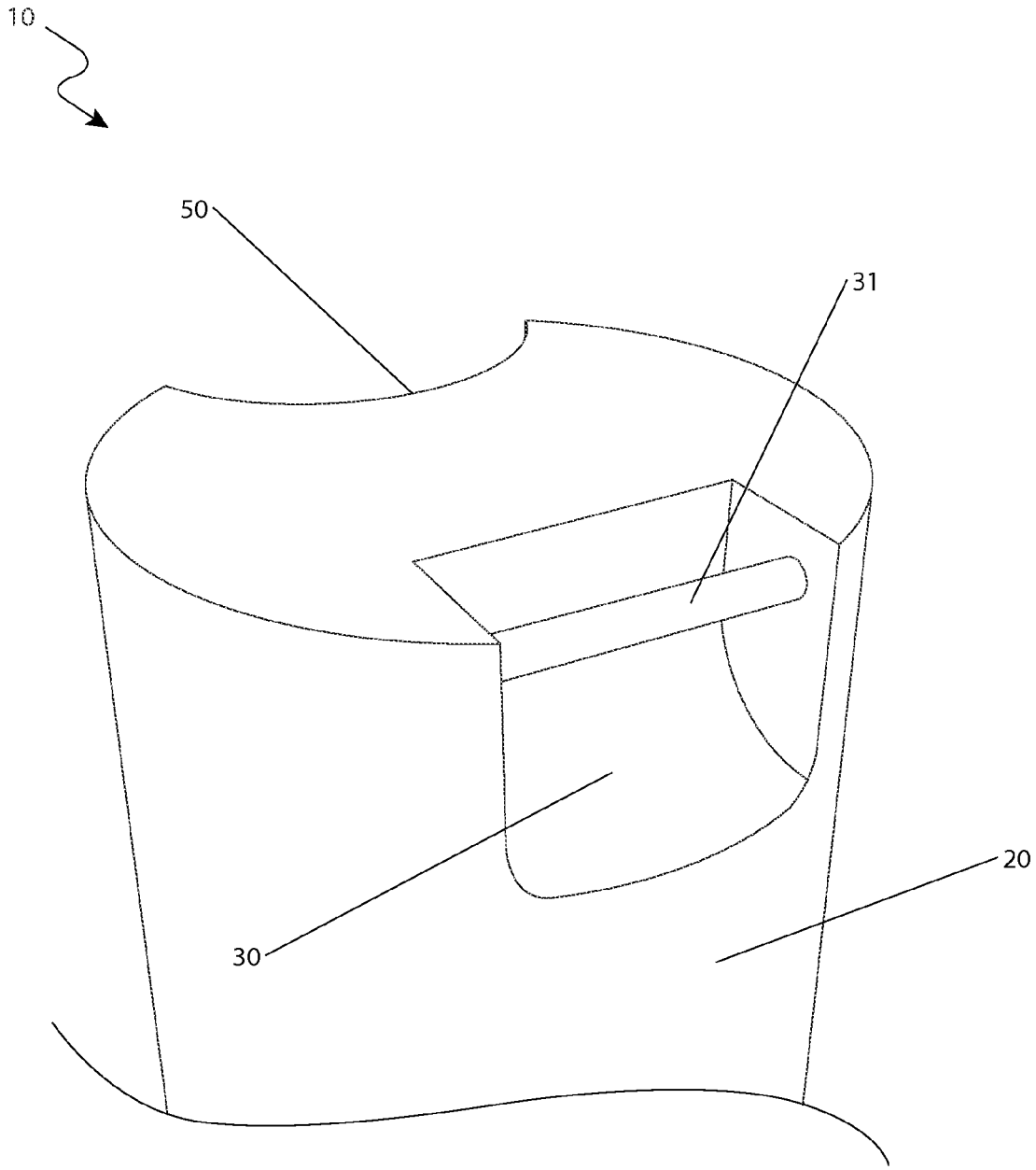
FIG. 7 is a partial bottom perspective view of the refuse carrying device, according to the preferred embodiment.
Figure 8:
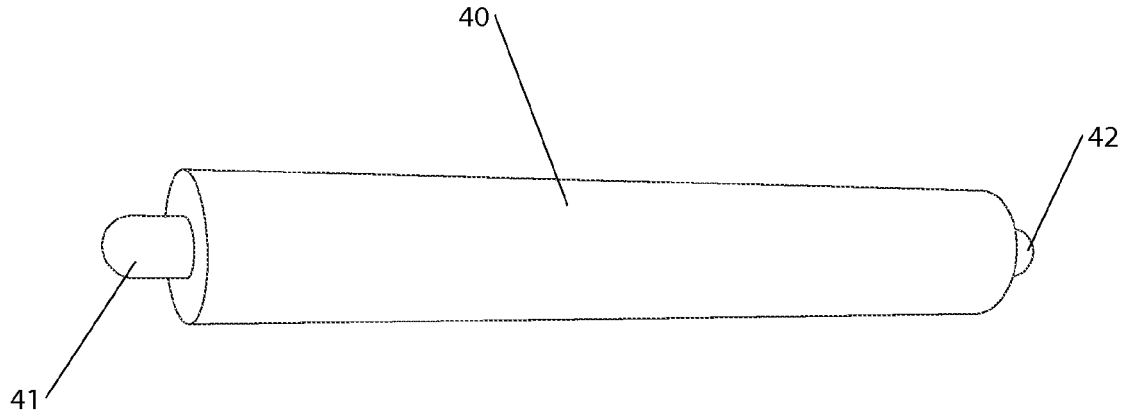
FIG. 8 is a front view of a secondary handle, according to the preferred embodiment.
Figure 9:
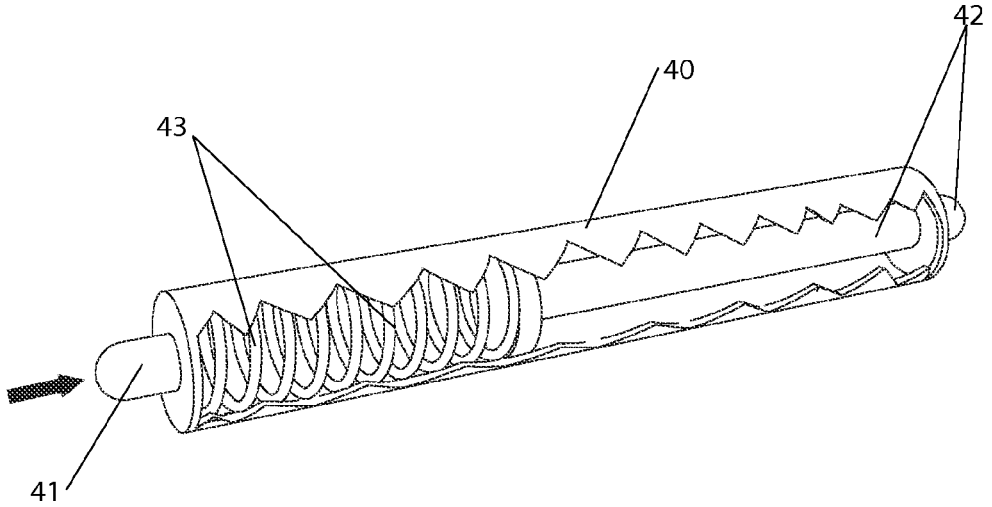
FIG. 9 is a cut-away perspective view of the secondary handle, according to the preferred embodiment.
Figure 10:
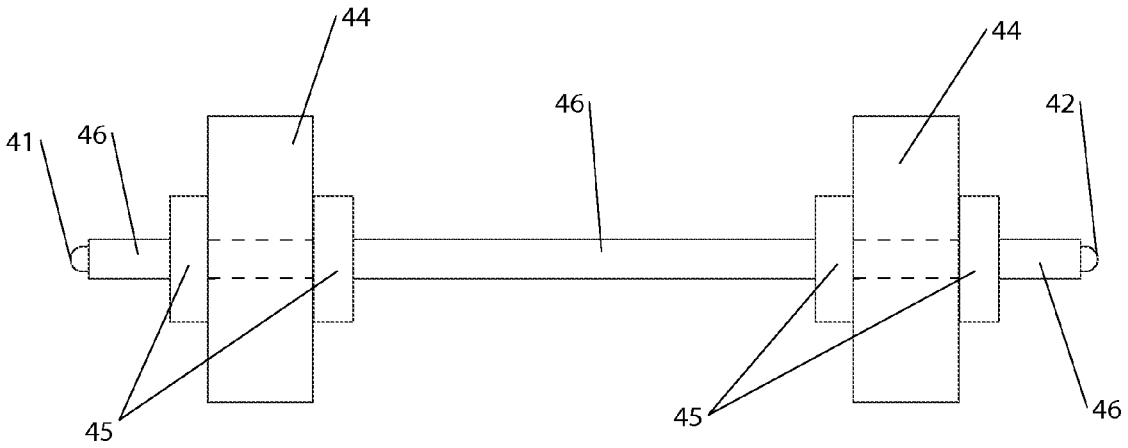
FIG. 10 is a front view of a wheel assembly, according to the preferred embodiment.
Figure 11:
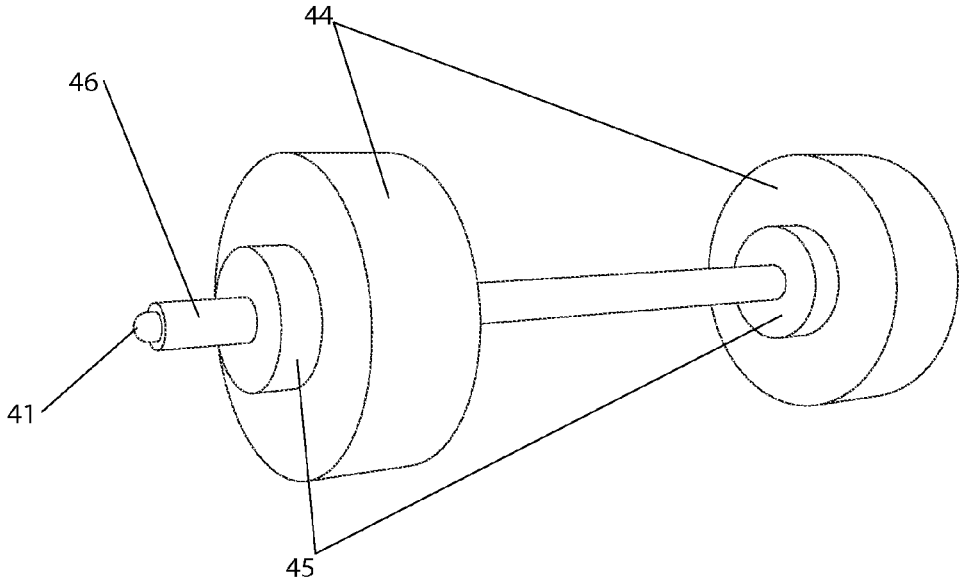
FIG. 11 is a perspective view of the wheel, according to the preferred embodiment.

FIG. 6 shows a bottom perspective view of the device 10, FIG. 7 shows another bottom perspective view of the device 10, FIG. 8 shows a front view of a secondary handle 40, FIG. 9 shows a perspective cut-away view of the secondary handle 40, FIG. 10 shows a front view of a wheel assembly 44, and FIG. 11 shows a perspective view of the wheel assembly 44. Upon the bottom surface 21 of the container 20 is the integrally molded handle recess 30 and cylindrical fixed handle 31. In use, the user holds the fixed handle 31 while the device 10 is positioned upon the shoulder or during similar handling techniques.

The shoulder recess 50 provides a position for accessories, such as a secondary handle 40 (see FIGS. 8 and 9) and a wheel assembly 44. The shoulder recess 50 includes opposing detents 53 which provide a securing position to fix the secondary handle 40 or the wheel assembly 44. The secondary handle 40 provides a supporting handling feature while the device 10 is being transported. The secondary handle 40 is removably attachable to the shoulder recess 50. The secondary handle 40 has a cylindrical body which provides another gripping surface for the user 15 to hold when handling the device 10. A fixed pin 41 and a compressible pin 42 slightly extend from opposing ends of the secondary handle 40 to provide a feature to engage the detents 53. The detents 53 are molded into opposing interior surfaces of the shoulder recess 50 and disposed along a common axis. To position the secondary handle 40 into the shoulder recess 50 the fixed pin 41 is placed within a detent 53 and the compressible pin 42 is compressed against an internal spring 43 to allow the compressible pin 42 to be positioned within the opposing detent 53. Once the compressible pin 42 is within its respective detent 53, the spring 43 pushes against the compressible pin 42 forcing it to extend outwardly and enter the detent 53 to secure the secondary handle 40 within the shoulder recess 50.

The wheel assembly 44 is depicted as a double-wheeled embodiment for illustration purposes and it can be appreciated that other embodiments, such as a single-wheeled embodiment can also be utilized without limiting the scope of the device 10. The wheel assembly 44 allows the container 20 to be rolled to a selected location on the ground surface. The wheel assembly 44 is utilized with a primary handle 25 which it used to direct the device 10 when being pushed or pulled. The wheel assembly 44 includes at least one wheel having an intermediately positioned bearing 45 to allow the wheels to rotate upon an axle 46. Each opposing end of the axle 46 has a fixed pin 41 and a compressible pin 42 which provide an engagable attachment to the detents 53 in a fashion similar to the secondary handle 30. The axle 46 also includes a spring 43 within its interior to bias the compressible pin 42 outward.

Figure 12:
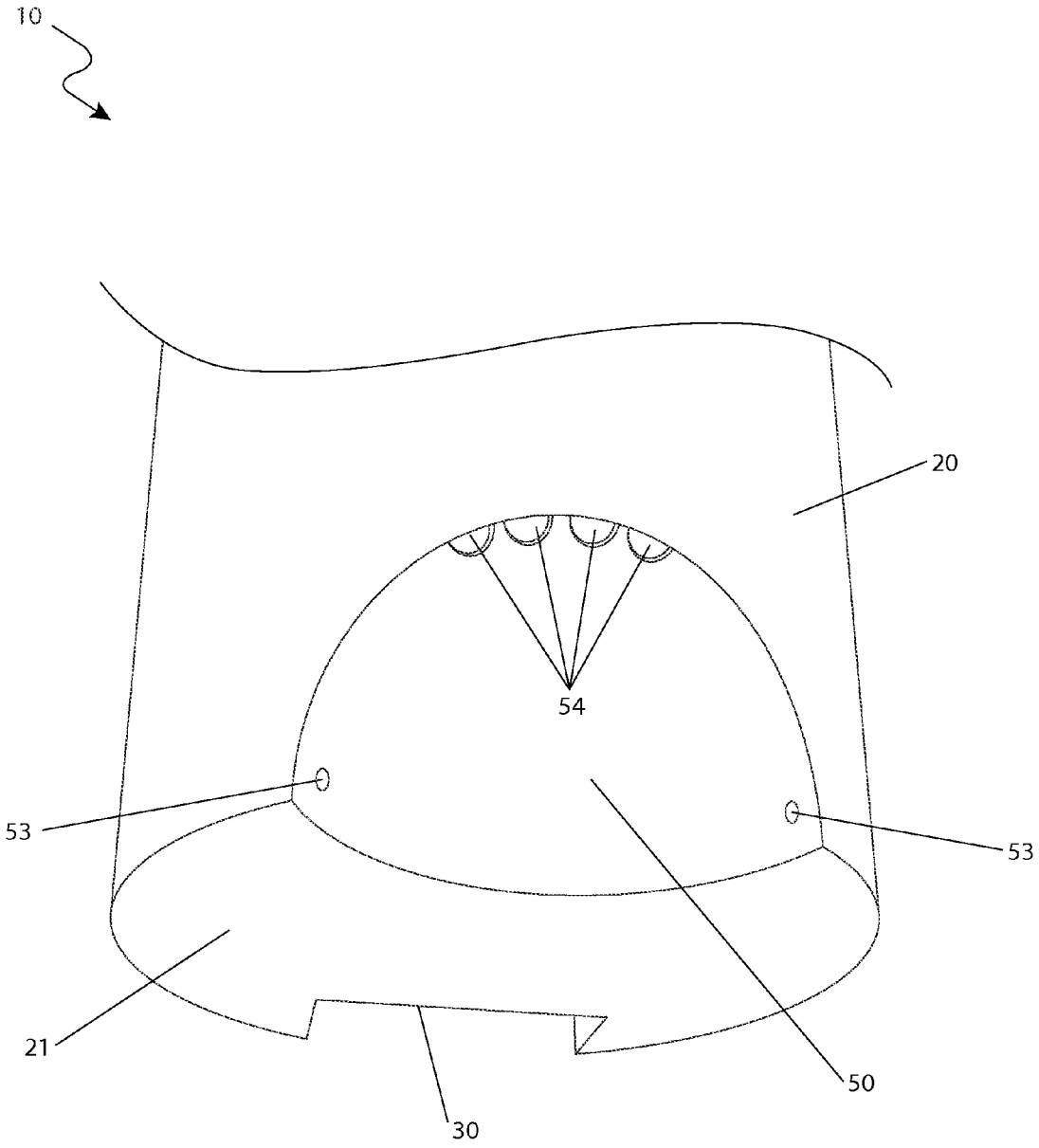
FIG. 12 is a partial bottom perspective view of the refuse carrying device, according to a preferred embodiment; and, FIG. 13 is a perspective view of a shoulder pad, according to the preferred embodiment.
Figure 13:
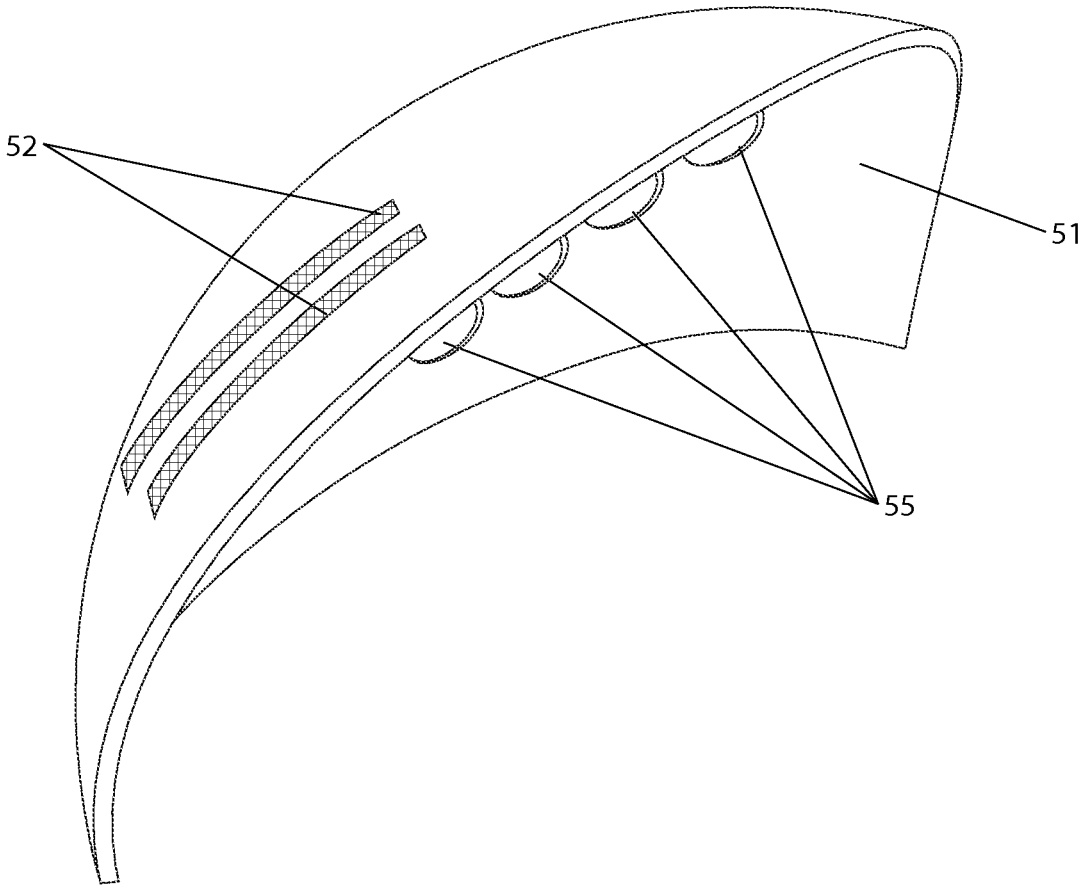

FIG. 12 shows a bottom perspective view of the device 10 and FIG. 13 shows a perspective view of a shoulder pad 51. Opposing the handle recess 30 is the shoulder recess 50 which is a concave indentation having a diameter of approximately nine (9) inches. When not being utilized with the secondary handle 40 or the wheel assembly 44, The shoulder recess 50 can be utilized to receive an upper shoulder of the user 15 to provide for a steadying support surface while being carried. The shoulder recess 50 extends from the bottom surface 21 upwardly onto the interior 22 of the container 20. The shoulder recess 50 also includes a plurality of container finger reliefs 54 which provide a finger receiving position for the user's hand to hold or support the container 20 during lifting or lowering of the device 10.

A shoulder pad 51 can be attached within the shoulder recess 50 to provide increased comfort to the user's shoulder while carrying the device 10. The shoulder pad 51 has a concave shape substantially identical to the shape of the shoulder recess 50. The shoulder pad 51 is attached to the shoulder recess 50 by a fastener 52 which can include, but not limited to: adhesives, hook-and-loop fasteners, or similar removable fasteners. The fastener 52 is depicted as attached to a rear surface of the shoulder pad 51 to engage an exterior surface of the shoulder recess 50. The shoulder pad 51 also includes a plurality of shoulder pad finger reliefs 55 to match the container finger reliefs 54 and provide the user with finger recesses to handle the container 20 while the shoulder pad 51 is attached.

It is envisioned that other styles and configurations can be easily incorporated into the teachings of the present disclosure and only one particular configuration has been shown and described for purposes of clarity and disclosure and not by way of limitation of scope.

In accordance with the invention, certain embodiments can be utilized by the user in a simple and effortless manner with little or no training. After initial purchase or acquisition of the device 10, it is installed and utilized as indicated in FIGS. 1.

The method of installing and utilizing the device 10 can be achieved by performing a series of steps as described. It can be appreciated that the steps described can be performed in alternative order and as such should not be viewed as a limiting factor. Acquiring the device 10 and filling the interior 22 with desired contents. Transporting the device 10 to the selected location by gripping the primary handles 25 or collar 23. Positioning the lid 35 onto the container 20 with the lid collar 37 engaging the collar 23 and utilizing the device 10.

An alternate method of installing and utilizing the device 10 can be achieved by performing a series of steps. Acquiring the device 10 and positioning the shoulder pad 51 within the shoulder recess 50 with the attachment fasteners 52. Filling the interior 22 with contents. Positioning the lid 35 onto the container 20 with the lid collar 37 engaging the collar 23. Lifting the device 10 by the primary handles 25 upwardly and positioning the shoulder recess 50 on the shoulder of the user 15. Grasping the fixed handle 31 and transporting the device 10 to the selected location and replacing the device 10 on the ground surface.

An alternate method of installing and utilizing the device 10 can be achieved by performing a series of steps. Acquiring the device 10 and installing the wheel assembly 44 within the shoulder recess 50 by insertingly engaging the pins 41, 42 within respective opposing detents 53. Filling the interior 22 with contents. Positioning the lid 35 onto the container 20 with the lid collar 37 engaging the collar 23. Directing the device 10 with the primary handles 25 while the wheel assembly 44 rolls across the ground surface and transporting the device 10 to the selected location.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A refuse carrying device comprising:

a container having an open top and a hollow interior;

a pair of primary handles affixed to an upper perimeter of said container;

a handle recess disposed in a bottom surface of said container contiguous with a lower perimeter edge;

a fixed handle affixed within said handle recess;

a shoulder recess disposed in said bottom surface of said container contiguous with said lower perimeter edge for contact with a shoulder of a carrier when said container is carried, said shoulder recess comprising a pair of detents disposed through opposing interior surfaces defining said shoulder recess;

a secondary handle comprising a pair of pins integral to and extending from opposing ends of said secondary handle; and a wheel assembly comprising a pair of pins integral to and extending from opposing ends of said wheel assembly;

wherein each of said secondary handle and said wheel assembly are interchangeably attached to said container within said shoulder recess.

2. The device of claim 1, wherein said container further comprises:

an outwardly protruding annular container collar disposed around said upper perimeter; and, a plurality of stiffening features affixed between an exterior of said container and said collar.

3. The device of claim 1, wherein said pair of primary handles each further comprises a generally "U"-shaped handle integral to said container.

4. The device of claim 1, further comprising a lid removably attachable to said open top of said container.

5. The device of claim 4, wherein said lid further comprises an inwardly protruding annular lid collar disposed around an interior perimeter for an interference fit with said container collar.

6. The device of claim 5, wherein said lid further comprises a lid handle affixed to a top surface.

7. The device of claim 1, wherein said detents disposed in said shoulder recess are configured to insertably receive said pins of said secondary handle and said pins of said wheel assembly.

8. The device of claim 1, wherein said secondary handle further comprises a cylindrical body, said pair of pins being disposed on each opposing end of said body; wherein at least one pin of said pair of pins is retractable within said cylindrical body and is biased outwardly from said end by an interior spring.

9. The device of claim 1, wherein said wheel assembly further comprises a cylindrical axle and at least one wheel rotatably connected to said axle, said pair of pins being disposed on each opposing end of said axle; wherein at least one pin of said pair of pins is retractable within said axle and is biased outwardly from said end by an interior spring.

10. The device of claim 1, wherein said shoulder recess further comprises a plurality of finger reliefs disposed along an upper edge.

11. The device of claim 1, further comprising a cushioned shoulder pad removably attachable within said shoulder recess.

12. A refuse carrying device comprising:

a container having an open top and a hollow interior;

a pair of primary handles affixed to an upper perimeter of said container;

an handle recess disposed in a bottom surface of said container contiguous with a lower perimeter edge;

a fixed handle affixed within said handle recess;

a shoulder recess disposed in said bottom surface of said container contiguous with said lower perimeter edge opposite said handle recess for contact with a shoulder of a carrier when said container is carried, said shoulder recess comprising a pair of detents disposed through opposing interior surfaces defining said shoulder recess;

a secondary handle comprising a pair of handle pins integral to and extending from opposing ends of said secondary handle;

a wheel assembly comprising a pair of wheel pins integral to and extending from opposing ends of said wheel assembly;

a cushioned shoulder pad removably attachable within said shoulder recess; and a plurality of container finger reliefs disposed along an upper edge of said shoulder recess;

wherein each of said secondary handle, said wheel assembly, and said shoulder pad are interchangeably attached to said container within said shoulder recess.

13. The device of claim 12, wherein said pair of opposing detents are configured to insertably receive said pair of handle pins of said secondary handle or said pair of wheel pins of said wheel assembly; and, wherein said secondary handle further comprises a cylindrical body, said pair of pins being disposed on each opposing end of said body, at least one handle pin of said pair of handle pins being retractable within said cylindrical body and biased outwardly from said end by an interior spring; and, wherein said wheel assembly further comprises a cylindrical axle and at least one wheel rotatably connected to said axle, said pair of wheel pins being disposed on each opposing end of said axle, at least one wheel pin of said pair of wheel pins being retractable within said axle and biased outwardly from said end by an interior spring.

14. The device of claim 13, wherein said should pad further comprises a plurality of pad finger reliefs disposed along an upper edge to mate with said plurality of container finger reliefs.

15. The device of claim 14, further comprising a lid removably coupled to said open top of said container.

* * * * *